US009886898B2

(12) United States Patent
Xuan et al.

(10) Patent No.: US 9,886,898 B2
(45) Date of Patent: Feb. 6, 2018

(54) PIXEL DRIVING CIRCUIT, DRIVING METHOD FOR PIXEL DRIVING CIRCUIT AND DISPLAY DEVICE

(71) Applicants: BOE TECHNOLOGY GROUP CO., LTD., Beijing (CN); ORDOS YUANSHENG OPTOELECTRONICS CO., LTD., Ordos, Inner Mongolia (CN)

(72) Inventors: Minghua Xuan, Beijing (CN); Taegyu Kim, Beijing (CN)

(73) Assignees: BOE TECHNOLOGY GROUP CO., LTD., Beijing (CN); ORDOS YUANSHENG OPTOELECTRONICS CO., LTD., Ordos, Inner Mongolia (CN)

( * ) Notice: Subject to any disclaimer, the term of this patent is extended or adjusted under 35 U.S.C. 154(b) by 0 days.

(21) Appl. No.: 14/442,391

(22) PCT Filed: Aug. 18, 2014

(86) PCT No.: PCT/CN2014/084631
§ 371 (c)(1),
(2) Date: May 12, 2015

(87) PCT Pub. No.: WO2015/169006
PCT Pub. Date: Nov. 12, 2015

(65) Prior Publication Data

US 2017/0047002 A1 Feb. 16, 2017

(30) Foreign Application Priority Data

May 7, 2014 (CN) ..... 2014 1 0190523

(51) Int. Cl.
*G09G 3/32* (2016.01)
*G09G 3/3233* (2016.01)
*G09G 3/3291* (2016.01)

(52) U.S. Cl.
CPC ..... *G09G 3/3233* (2013.01); *G09G 3/32* (2013.01); *G09G 3/3291* (2013.01);
(Continued)

(58) Field of Classification Search
CPC ..... G09G 2300/043; G09G 2300/0809; G09G 2320/043; G09G 3/32; G09G 3/3233; G09G 3/3291
See application file for complete search history.

(56) References Cited

U.S. PATENT DOCUMENTS 7,057,588 B2 * 6/2006 Asano ..... G09G 3/3233 345/76
7,612,747 B2 * 11/2009 Huang ..... G09G 3/3233 315/169.3

(Continued)

FOREIGN PATENT DOCUMENTS

CN 101405785 4/2009
CN 102831859 12/2012

(Continued)

OTHER PUBLICATIONS

Chinese Office Action with English Language Translation, dated Aug. 5, 2015, Chinese Application No. 201410190523.7.

(Continued)

*Primary Examiner* — Afroza Chowdhury
(74) *Attorney, Agent, or Firm* — Blakely Sokoloff Taylor & Zafman LLP

(57) ABSTRACT

The embodiment of the invention provides a pixel driving circuit, a driving method for the pixel driving circuit and a display device, and relates to the technical field of display.

(Continued)

According to the pixel driving circuit, the driving method for the pixel driving circuit and the display device, the situation that driving currents of an active light emitting device are affected by threshold voltage shift of a driving transistor can be avoided, and therefore the evenness of a displayed image is improved. The pixel driving circuit comprises a light emitting device, a storage capacitor, a driving unit and five switching units. The embodiments of the invention are used in e.g. display devices and manufacturing the same.

11 Claims, 5 Drawing Sheets

(52) U.S. Cl.
CPC ..... *G09G 2300/043* (2013.01); *G09G 2300/0809* (2013.01); *G09G 2320/043* (2013.01)

(56) References Cited

U.S. PATENT DOCUMENTS

| | | | | |
|---|---|---|---|---|
| 8,797,314 | B2 * | 8/2014 | Chung | G09G 3/3233 345/76 |
| 2004/0070557 | A1 * | 4/2004 | Asano | G09G 3/3233 345/76 |
| 2007/0146247 | A1 | 6/2007 | Huang et al. | |
| 2009/0040150 | A1 | 2/2009 | Senda | |
| 2009/0207158 | A1 | 8/2009 | Park et al. | |
| 2010/0073266 | A1 | 3/2010 | Na et al. | |
| 2011/0134100 | A1 * | 6/2011 | Chung | G09G 3/325 345/212 |
| 2013/0314305 | A1 * | 11/2013 | Liu | G09G 3/32 345/77 |

FOREIGN PATENT DOCUMENTS

| | | |
|---|---|---|
| CN | 103117041 | 5/2013 |
| CN | 103971640 | 8/2014 |
| KR | 20080050113 | 1/2006 |

OTHER PUBLICATIONS

International Search Report with English Language Translation, dated Jan. 28, 2015, Application No. PCT/CN2014/084631.
Chinese Office Action with English Language Translation, dated Jan. 20, 2016, Chinese Application No. 201410190523.7.
Search Report in European Application No. 14861171.8 dated Oct. 10, 2017.

* cited by examiner

PIXEL DRIVING CIRCUIT, DRIVING METHOD FOR PIXEL DRIVING CIRCUIT AND DISPLAY DEVICE

FIELD OF THE INVENTION

The present invention relates to the technical field of display, in particular to a pixel driving circuit, a driving method for the pixel driving circuit and a display device.

BACKGROUND OF THE INVENTION

Active matrix organic light emitting diode (AMOLED) display is one of the hot researches in the field of flat panel display. Compared with the liquid crystal display, organic light emitting diode (OLED) has the advantages of low energy consumption, low production cost, self luminescence, wide viewing angle and quick response, etc. At present, in the display field of mobile phone, PDA (Personal Digital Assistant, or palmtop computer) and digital camera, OLED has begun to replace the traditional LCD display screen. The pixel driving circuit design is the core technical content of AMOLED display, which has important research significance.

Different with TFT-LCD (Thin Film Transistor Liquid Crystal Display) applying stable voltage for the control of brightness, OLED is driven by current, and stable current is needed to control the emitting of light. For the reasons such as technology process and aging of device, in the existing driving circuit with two transistor T1, T2 and one storage capacitor C1 (as shown in FIG. 1), the driving current $I_{OLED}$ is a current generated by applying the voltage Vdata provided by the data line on the saturation region of the driving transistor (DTFT). This current drives the OLED for emitting light, wherein the calculation formula of the driving current is $I_{OLED}=K(V_{GS}-Vth)^2$, the $V_{GS}$ is the voltage between the gate and the source of the driving transistor, and the Vth is the threshold voltage of the driving transistor. For the reasons such as technology process and aging of device, the threshold voltages (Vth) of the driving TFTs of individual pixels are uneven. Since the threshold voltages of the driving TFTs (i.e., T2 in FIG. 1) of individual pixels are uneven, there is difference between the currents flowing through the OLEDs of individual pixels, affecting the display effect of the entire image.

SUMMARY OF THE INVENTION

According to the pixel driving circuit, the driving method for the pixel driving circuit and the display device, the situation that driving currents of an active light emitting device are affected by threshold voltage shift of a driving transistor can be avoided, and therefore the evenness of a displayed image is improved.

To this end, the embodiments of the present invention provide the following solutions.

In an aspect, a pixel driving circuit is provided; the pixel driving circuit comprises a light emitting device, a storage capacitor, a driving unit and five switching units;

wherein each switching unit comprises a control port, a first signal port and a second signal port; the control port of the switching unit is used for inputting a control signal, thereby turning on or turning off the first signal port and the second signal port; the drive unit comprises a control port, a signal input port and a driving port, the control port and the signal input port of the driving unit are used for controlling outputting a driving signal at the driving port;

a control port of a first switching unit is used for inputting a reset signal; a first signal port of the first switching unit is used for inputting an initializing level;

a control port of a second switching unit is used for inputting a first scanning signal; a first signal port of the second switching unit is connected to a second signal port of the first switching unit;

a first electrode of the storage capacitor is connected to the first signal port of the second switching unit;

a control port of a third switching unit is used for inputting a second scanning signal; a first signal port of the third switching unit is used for inputting a data signal; a second signal port of the third switching unit is connected to a second electrode of the storage capacitor;

a control port of a fourth switching unit is used for inputting a third scanning signal; a first signal port of the fourth switching unit is used for inputting a first level; a second signal port of the fourth switching unit is connected to the second electrode of the storage capacitor;

a control port of a fifth switching unit is used for inputting a fourth scanning signal; a first signal port of the fifth switching unit is connected to a second signal port of the second switching unit;

the control port of the driving unit is connected to the first electrode of the storage capacitor; the signal input port of the driving unit is used for inputting the first level; the driving port of the driving unit is connected to the first signal port of the fifth switching unit;

a first electrode of the light emitting device is connected to a second signal port of the fifth switching unit; a second electrode of the light emitting device is used for inputting a second level.

Optionally, each of the scanning signals is inputted to a control port of a corresponding switching unit through a scanning line.

Optionally, the control port of the second switching unit and the control port of the third switching unit are connected to a same scanning line.

Optionally, the control port of the fifth switching unit and the control port of the fourth switching unit are connected to different scanning lines respectively; and the third scanning signal is not synchronized with the fourth scanning signal.

Optionally, the switching units are switching transistors; the gates of the switching transistors are used as the control ports of the switching units; the sources and the drains of the switching transistors are respectively used as the first signal ports and the second signal ports of the switching units; or, the sources and the drains of the switching transistors are respectively used as the second signal ports and the first signal ports of the switching units.

Optionally, the driving unit is a driving transistor; the gate of the driving transistor is used as the control port of the driving unit; the source of the driving transistor is used as the signal input port of the driving unit; the drain of the driving transistor is used as the driving port of the driving unit.

In another aspect, a driving method for the pixel driving circuit is provided; the driving method comprises:

a first phase: the first signal port and the second signal port of the first switching unit are turned on; the first signal port and the second signal port of the fourth switching unit are turned on; the initializing level and the first level charge the storage capacitor;

a second phase: the first signal port and the second signal port of the second switching unit are turned on; the first signal port and the second signal port of the third switching unit are turned on; the data signal is written in the second electrode of the storage capacitor; the first electrode of the storage capacitor is discharged until the voltage difference between the control port and the signal input port of the driving unit is equal to the threshold voltage of the driving unit;

a third phase: the first signal port and the second signal port of the fourth switching unit are turned on; the first signal port and the second signal port of the fifth switching unit are turned on; the first level is coupled with the first electrode of the storage capacitor and pull up the potential of the first electrode of the storage capacitor; under the control of the output voltage of the first electrode of the storage capacitor, the driving unit outputs the driving signal at the driving port for driving the light emitting device to emit light.

Optionally, if the switching units are switching transistors, the switching transistors comprise a cut-off state and a turn-on state.

Optionally, if the driving unit is a driving transistor, the driving transistor is in a saturation state in the third phase.

In yet another aspect, a display device comprising the above mentioned pixel driving circuit is provided.

According to the pixel driving circuit, the driving method for the pixel driving circuit and the display device, the situation that driving currents of an active light emitting device are affected by threshold voltage shift of a driving transistor can be avoided in a way of voltage compensation, and therefore the evenness of a displayed image is improved.

BRIEF DESCRIPTION OF THE DRAWINGS

In order to more clearly illustrate the technical solutions in embodiments of the invention or in the prior art, the appended drawings needed to be used in the description of the embodiments or the prior art will be introduced briefly in the following. Obviously, the drawings in the following description are only some embodiments of the invention, and for those of ordinary skills in the art, other drawings may be obtained according to these drawings under the premise of not paying out creative work.

DETAILED DESCRIPTION OF THE INVENTION

In the following the technical solutions in embodiments of the invention will be described clearly and completely in connection with the drawings in the embodiments of the invention. Obviously, the described embodiments are just a part of the embodiments of the invention, and not all the embodiments. Based on the embodiments in the invention, all the other embodiments obtained by those of ordinary skills in the art under the premise of not paying out creative work pertain to the scope protected by the invention.

The switching transistors and driving transistors in all the embodiments of the invention can be thin film transistors or field effect transistors or other devices with a same property. Since the source and the drain of the switching transistor used herein are symmetrical, the source and the drain are interchangeable. In an embodiment of the invention, to distinguish two electrodes of the transistor besides the gate, one of these two electrodes is called source, and the other one is called drain. According to the drawings, the middle port of the transistor is defined as the gate; the signal input port is defined as the source; and the signal output port is defined as the drain. In addition, the switching transistors applied in the embodiments of the invention comprise P type switching transistors and N type switching transistors; wherein P type switching transistors can be turned on when the gate is provided with low level, while can be turned off when the gate is provided with high level; N type switching transistors can be turned on when the gate is provided with high level, while can be turned off when the gate is provided with low level. The driving transistors applied in the embodiments of the invention comprise P type driving transistors and N type driving transistors; wherein the P type driving transistors are in magnifying state or saturation state when the gate voltage is low level (i.e., the gate voltage is lower than the source voltage) and the absolute value of the voltage difference between the gate and the source is higher than the threshold voltage; the N type driving transistors are in magnifying state or saturation state when the gate voltage is high level (i.e., the gate voltage is higher than the source voltage) and the absolute value of the voltage difference between the gate and the source is higher than the threshold voltage.

Figure 1:
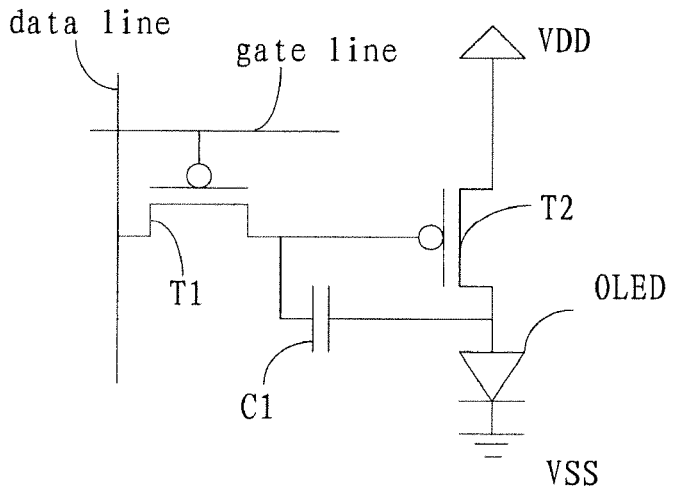
FIG. 1 is a structural schematic diagram of a pixel driving circuit in the prior art.
Figure 2:
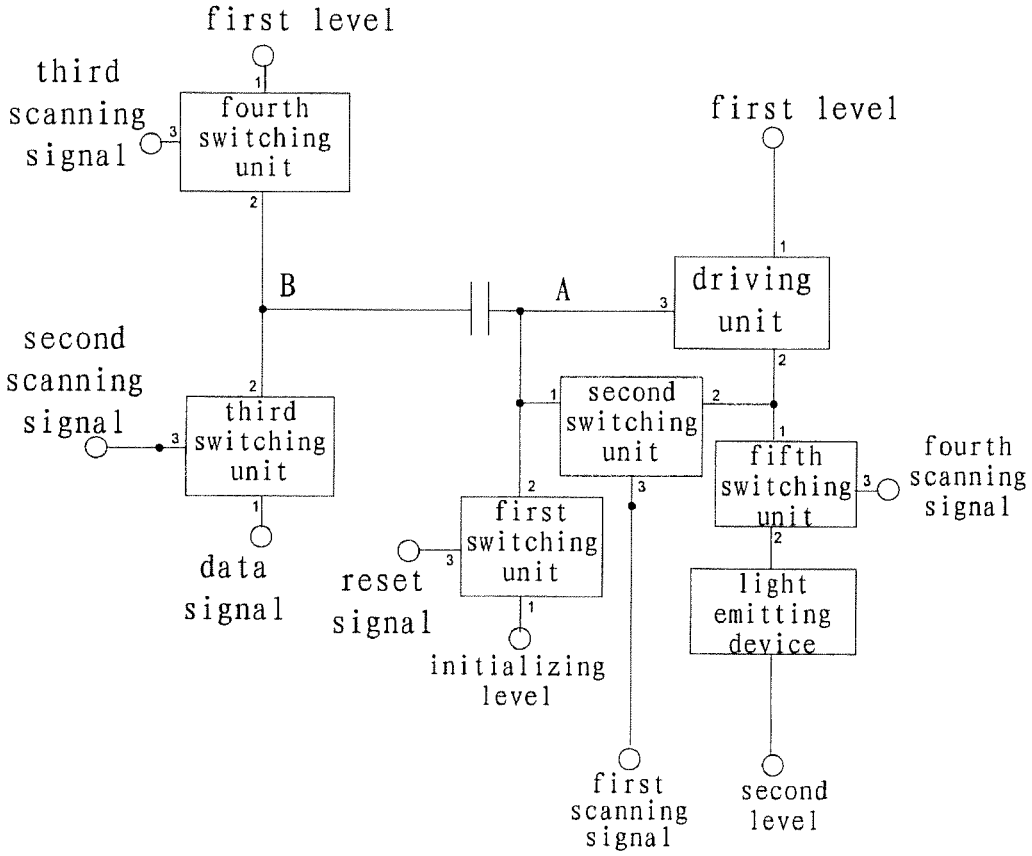
FIG. 2 is a structural schematic diagram of a pixel driving circuit provided by an embodiment of the present invention.

As shown in FIG. 2, an embodiment of the present invention provides a pixel driving circuit; the pixel driving circuit comprises a light emitting device, a storage capacitor, a driving unit and five switching units;

wherein each switching unit comprises a control port, a first signal port and a second signal port; the control port of the switching unit is used for inputting a control signal, thereby turning on or turning off the first signal port and the second signal port; the drive unit comprises a control port, a signal input port and a driving port, the control port and the signal input port of the driving unit are used for controlling outputting a driving signal at the driving port;

a control port of a first switching unit is used for inputting a reset signal; a first signal port of the first switching unit is used for inputting an initializing level;

a control port of a second switching unit is used for inputting a first scanning signal; a first signal port of the second switching unit is connected to a second signal port of the first switching unit;

a first electrode of the storage capacitor is connected to the first signal port of the second switching unit;

a control port of a third switching unit is used for inputting a second scanning signal; a first signal port of the third switching unit is used for inputting a data signal; a second signal port of the third switching unit is connected to a second electrode of the storage capacitor;

a control port of a fourth switching unit is used for inputting a third scanning signal; a first signal port of the fourth switching unit is used for inputting a first level; a second signal port of the fourth switching unit is connected to the second electrode of the storage capacitor;

a control port of a fifth switching unit is used for inputting a fourth scanning signal; a first signal port of the fifth switching unit is connected to a second signal port of the second switching unit;

the control port of the driving unit is connected to the first electrode of the storage capacitor; the signal input port of the driving unit is used for inputting the first level; the driving port of the driving unit is connected to the first signal port of the fifth switching unit;

a first electrode of the light emitting device is connected to a second signal port of the fifth switching unit; a second electrode of the light emitting device is used for inputting a second level.

Optionally, each of the scanning signals is inputted to a control port of a corresponding switching unit through a scanning line. The control port of the second switching unit and the control port of the third switching unit are connected to a same scanning line. It can be understood that scanning signals with a same time sequence can be inputted to the control ports of the switching units if these control ports are connected to a same scanning line.

It should be noted that, in FIG. 2, the ports of each switching unit and each driving unit are indicated with numbers 1, 2 and 3, wherein the control port of each switching unit is port 3, the first signal port is port 1, and the second signal port is port 2; the control port of each driving unit is port 3, the signal input port is port 1, and the driving port is port 2.

According to the pixel driving circuit provided by the embodiment of the invention, the situation that driving currents of an active light emitting device are affected by threshold voltage shift of a driving transistor can be avoided in a way of voltage compensation, and therefore the evenness of a displayed image is improved.

An embodiment of the present invention provides a driving method for the pixel driving circuit is provided; the driving method comprises:

a first phase: the first signal port and the second signal port of the first switching unit are turned on; the first signal port and the second signal port of the fourth switching unit are turned on; the initializing level and the first level charge the storage capacitor;

a second phase: the first signal port and the second signal port of the second switching unit are turned on; the first signal port and the second signal port of the third switching unit are turned on; the data signal is written in the second electrode of the storage capacitor; the first electrode of the storage capacitor is discharged until the voltage difference between the control port and the signal input port of the driving unit is equal to the threshold voltage of the driving unit;

a third phase: the first signal port and the second signal port of the fourth switching unit are turned on; the first signal port and the second signal port of the fifth switching unit are turned on; the first level is coupled with the first electrode of the storage capacitor and pull up the potential of the first electrode of the storage capacitor; under the control of the output voltage of the first electrode of the storage capacitor, the driving unit outputs the driving signal at the driving port for driving the light emitting device to emit light.

It can be understood that, the default state of each switching unit is: the first signal port and the second signal port of the switching unit are in off-state. In the above mentioned process, it is indicated that in each phase the first signal port and the second signal port of the switching unit are switched into turn-on state; therefore, in each phase, except those switching units of which the first signal port and the second signal port are turned on, the first signal port and the second signal port of other switching units are in off-state.

According to the driving method for the pixel driving circuit provided by the embodiment of the invention, the situation that driving currents of an active light emitting device are affected by threshold voltage shift of a driving transistor can be avoided in a way of voltage compensation, and therefore the evenness of a displayed image is improved.

Further optionally, the control port of the fifth switching unit and the control port of the fourth switching unit are connected to different scanning lines respectively; and the third scanning signal is not synchronized with the fourth scanning signal. Referring to the driving method for the pixel driving circuit, it can be seen that the turn-on time sequence of the first signal port and the second signal port of the fourth switching unit is not completely synchronized with the turn-on time sequence of the first signal port and the second signal port of the fifth switching unit; with the control port of the fifth switching unit and the control port of the fourth switching unit being connected to different scanning lines respectively, the inputted third scanning signal is not synchronized with the fourth scanning signal, therefore the fourth switching unit and the fifth switching unit can be controlled respectively, realizing a precise control on the pixel display time; meanwhile, the stability of the light emitting device can also be ensured, it is avoided that a current flows through the light emitting device outside the light emitting phase, prolonging the lifetime of the device.

Figure 3:
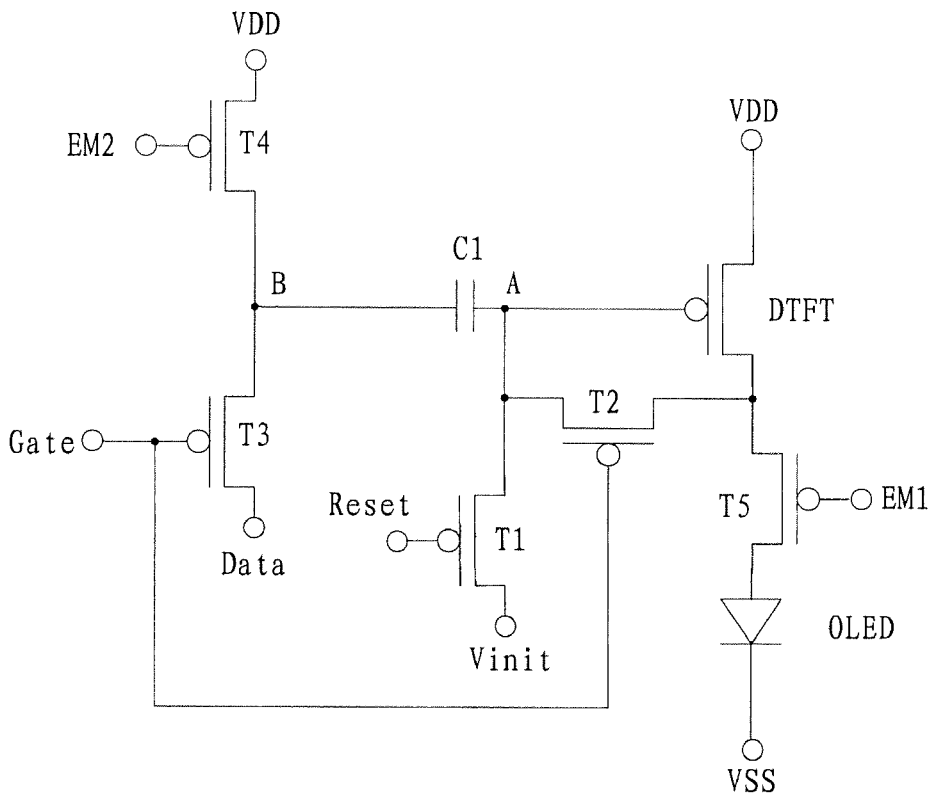
FIG. 3 is a structural schematic diagram of a pixel driving circuit provided by another embodiment of the present invention.

In particular, an embodiment is illustrated, in which the switching units are switching transistors, and the driving unit is a driving transistor. Based on the physical property of the above mentioned switching transistors and driving transistor, the gates of the switching transistors are used as the control ports of the switching units; the sources and the drains of the switching transistors are respectively used as the first signal ports and the second signal ports of the switching units; or, the sources and the drains of the switching transistors are respectively used as the second signal ports and the first signal ports of the switching units. The gate of the driving transistor is used as the control port of the driving unit; the source of the driving transistor is used as the signal input port of the driving unit; the drain of the driving transistor is used as the driving port of the driving unit. As shown in FIG. 3, a pixel driving circuit is provided; the pixel driving circuit comprises five switching units (indicated with T1-T5 sequentially), a driving transistor DTFT, and a storage capacitor C1, wherein the storage capacitor comprises a first electrode (connected to node A) and a second electrode (connected to node B). In this circuit, all the transistors are for example P type transistors, wherein the first level is a high level VDD, the second level is a low level VSS, the first scanning line Gate provides a scanning signal for T2 and T3, the second scanning line EM1 provides a scanning signal for T5, the third scanning line EM2 provides a scanning signal for T4, the data line Data provides a data signal for the source of T3, Vinit is an initializing level provided when the reset signal Reset is inputted, VDD and VSS are used to power the light emitting device.

Reset is inputted to the gate of T1, Vinit is inputted to the source of T1, and the drain of T1 is connected to the node A; the gate of T2 is connected to Gate, the source of T2 is connected to the node A, and the drain of T2 is connected to the drain of DTFT; the source of T3 is connected to Data, the gate of T3 is connected to Gate, and the drain of T3 is connected to the node B; VDD is inputted to the source of T4, the gate of T4 is connected to EM2, and drain of T4 is connected to the node B; the gate of T5 is connected to EM1, the source of T5 is connected to the drain of DTFT, the drain of T5 is connected to the first electrode of the light emitting device, and VSS is inputted to the second electrode of the light emitting device; the gate of DTFT is connected to the node A, and VDD is inputted to the source of DTFT.

Wherein the light emitting device can be an active light emitting diode OLED; since the first level is a high level, and the second level is a low level, the OLED can be a bottom emitting OLED; preferably, VSS is grounding.

Figure 4:
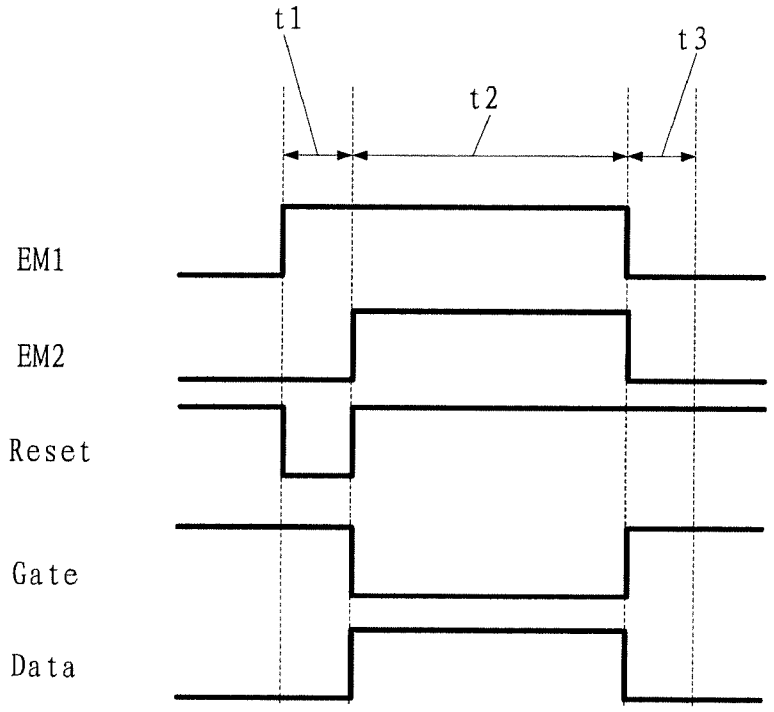
FIG. 4 is a schematic diagram of time sequence state for a pixel driving circuit provided by another embodiment of the present invention.
Figure 5A:
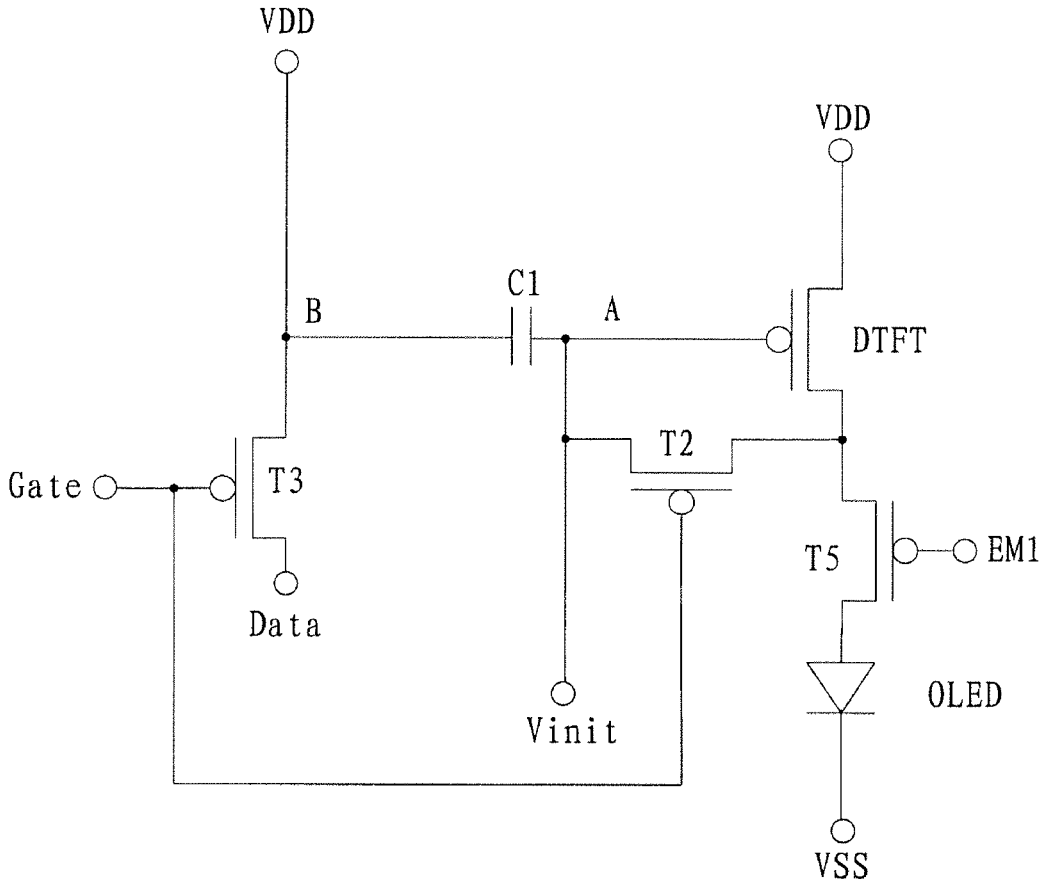
FIG. 5*a* is a schematic diagram of an equivalent circuit for a pixel driving circuit in a first phase, which pixel driving circuit is provided by an embodiment of the present invention.
Figure 5B:
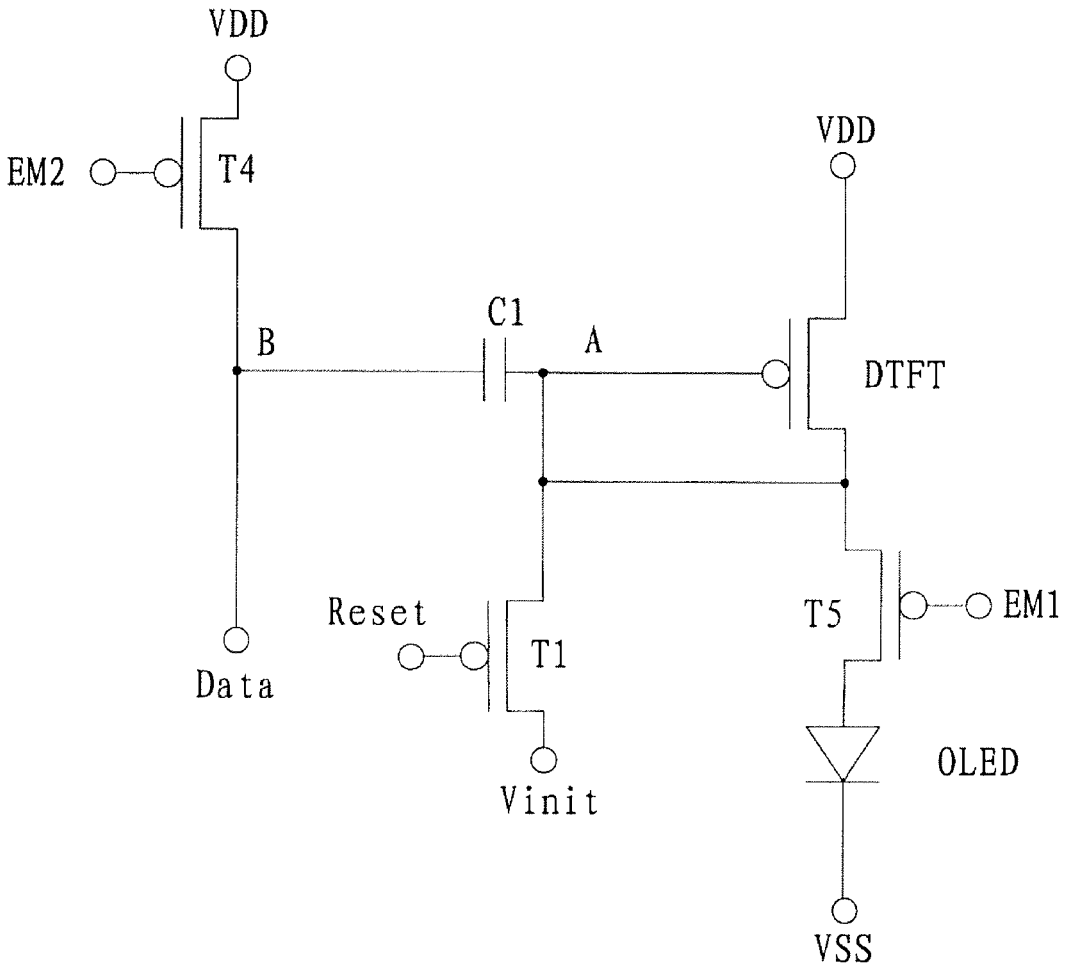
FIG. 5*b* is a schematic diagram of an equivalent circuit for a pixel driving circuit in a second phase, which pixel driving circuit is provided by an embodiment of the present invention.
Figure 5C:
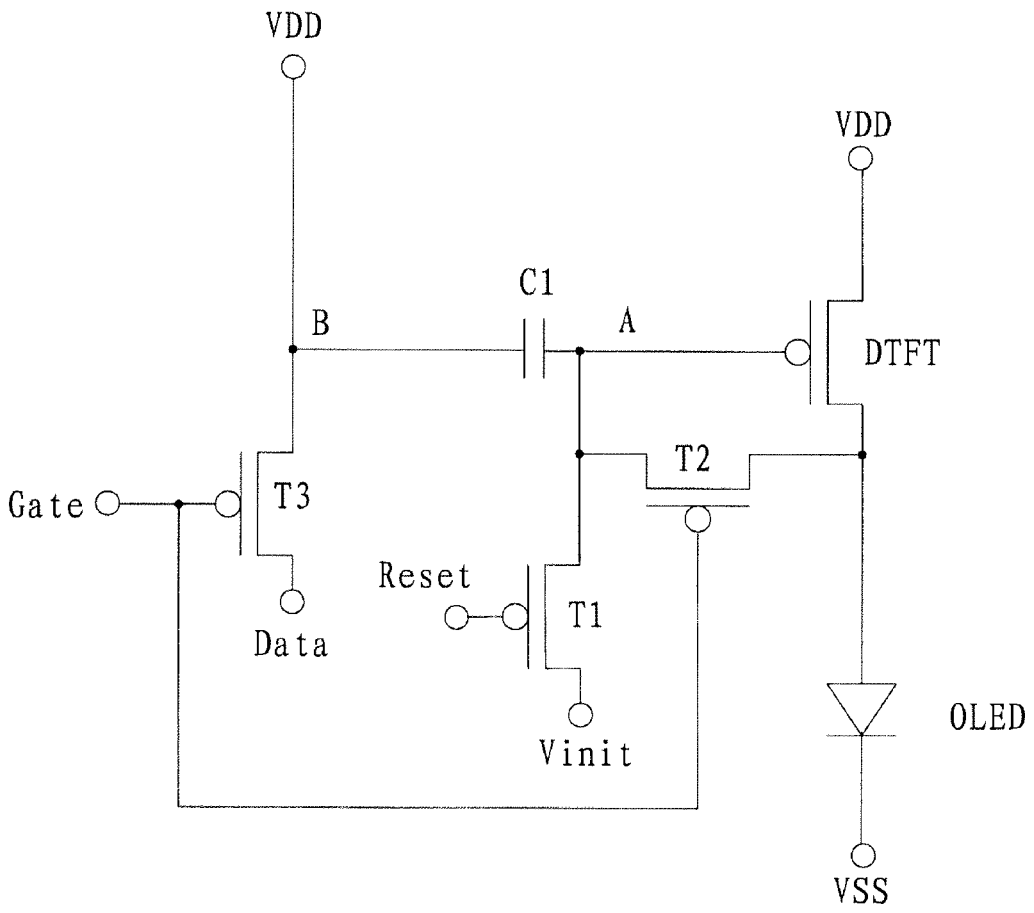
FIG. 5*c* is a schematic diagram of an equivalent circuit for a pixel driving circuit in a third phase, which pixel driving circuit is provided by an embodiment of the present invention.

In combination with the pixel driving circuit shown in FIG. 3, referring to the schematic diagram of time sequence state for every inputted signal of the pixel driving circuit provided in FIG. 4, and the schematic diagram of an equivalent circuit for a pixel driving circuit in every phase provided in FIGS. 5*a*~5*c*, the specific working principle of the circuit is illustrated.

The first phase t1 is a pixel initialization phase:

in this phase, a high level is inputted to EM1, a low level is inputted to EM2 and Reset simultaneously; T1 and T4 are turned on, the equivalent circuit at this time is shown in FIG. 5*a*. For the node A and node B across the capacitor C1, the level of the node A is Va=Vinit, the level of the node B is Vb=VDD.

The second phase t2 is a data writing phase:

a high level is inputted to EM1, EM2 and Reset simultaneously, a low level is inputted to Gate, a data signal is written to Vdata through Data data line; T2 and T3 are turned on, the equivalent circuit at this time is shown in FIG. 5*b*. At this time, since T2 is turned on, the gate and drain of DTFT are short-circuited, DTFT is in a diode state. At this time, the drain voltage of DTFT is VDD+Vth, the level on the node A of the capacitor C1 is Va=VDD+Vth, and the level on the node B of the capacitor C1 is Vb=Vdata, wherein Vth is the threshold voltage of DTFT.

The third phase t3 is a light emitting phase:

a low level is inputted to EM1 and EM2 simultaneously, T4 and T5 are turned on, the equivalent circuit at this time is shown in FIG. 5*c*. At this time, the level on the node B is changed to VDD;

according to the theorem of charge retention, the level on the node A is pulled up to Va=2VDD+Vth−Vdata;

at this time, $V_{GS}$=Va−VDD=2VDD+Vth−Vdata−VDD=VDD+Vth−Vdata.

Since DTFT is in a saturation state, the output current of DTFT is:

$$I_{OLED} = \frac{1}{2}\beta[V_{GS} - Vth]^2 = \frac{1}{2}\beta[VDD + Vth - Vdata - Vth]^2 = \frac{1}{2}\beta[VDD - Vdata]^2.$$

Based on the above formula, it can be seen that the driving current $I_{OLED}$ is only related with the value of the voltage of the data line Vdata, therefore, the driving current is not affected by Vth. In the formula, $V_{GS}$ is the voltage between the gate and source of TFT, $$\beta = \mu C_{ox}\frac{W}{L},$$

μ and $C_{ox}$ are constants of the process; W is the width of the TFT channel, L is the length of the TFT channel, both W and L are constants which can be optionally designed. At this time, the current on the pixel OLED is irrelevant to Vth.

The above mentioned embodiments are illustrated with the switching transistor and the driving transistor being P type transistor. Of course, the type of the transistor can be simply replaced, as long as the time sequence state inputted to the corresponding scanning signal line is adjusted accordingly. The embodiments of the invention do not limit the type of the switching transistor and driving transistor. When the type of the switching transistor and driving transistor is changed, only the level signal applied on the gate of the transistor should be adjusted, as long as it can realize the driving method for the pixel driving circuit provided by the embodiments of the invention. Any combination easily occurring to those skilled in the art based on the pixel driving circuit and the driving method provided by the embodiments of the invention should be encompassed within the protection scope of the invention.

According to the pixel driving circuit provided by the embodiment of the invention, the situation that driving currents of an active light emitting device are affected by threshold voltage shift of a driving transistor can be avoided in a way of voltage compensation, and therefore the evenness of a displayed image is improved.

An embodiment of the invention also provides a display device, the display device comprising the above mentioned pixel driving circuit. The display device can be display equipment such as electronic paper, mobile phone, TV, digital photo frame and so on.

According to the display device provided by the embodiment of the invention, the situation that driving currents of an active light emitting device are affected by threshold voltage shift of a driving transistor can be avoided in a way of voltage compensation, and therefore the evenness of a displayed image is improved.

The above description is just specific embodiments of the invention, however, the protection scope of the invention is not limited thereto, and variations or alternatives easily occurring to any artisan familiar with the technical field within the technical scope disclosed by the invention should be encompassed within the protection scope of the invention. Therefore, the protection scope of the invention should be subject to the protection scope of the claims.

The invention claimed is:

1. A pixel driving circuit, comprising: a light emitting device, a storage capacitor, a driving unit and five switching units;

wherein each switching unit comprises a control port, a first signal port and a second signal port; the control port of the switching unit is used for inputting a control signal, thereby turning on or turning off the first signal port and the second signal port; the drive unit comprises a control port, a signal input port and a driving port, the control port and the signal input port of the driving unit are used for controlling outputting a driving signal at the driving port;

a control port of a first switching unit is used for inputting a reset signal; a first signal port of the first switching unit is used for inputting an initializing level;

a control port of a second switching unit is used for inputting a first scanning signal; a first signal port of the second switching unit is connected to a second signal port of the first switching unit;

a first electrode of the storage capacitor is connected to the first signal port of the second switching unit;

a control port of a third switching unit is used for inputting a second scanning signal; a first signal port of the third switching unit is used for inputting a data signal; a second signal port of the third switching unit is connected to a second electrode of the storage capacitor;

a control port of a fourth switching unit is used for inputting a third scanning signal; a first signal port of the fourth switching unit is used for inputting a first level; a second signal port of the fourth switching unit is connected to the second electrode of the storage capacitor;

a control port of a fifth switching unit is used for inputting a fourth scanning signal; a first signal port of the fifth switching unit is connected to a second signal port of the second switching unit;

the control port of the driving unit is connected to the first electrode of the storage capacitor; the signal input port of the driving unit is used for inputting the first level; the driving port of the driving unit is connected to the first signal port of the fifth switching unit;

a first electrode of the light emitting device is connected to a second signal port of the fifth switching unit; a second electrode of the light emitting device is used for inputting a second level;

wherein each of the scanning signals is inputted to a control port of a corresponding switching unit through a scanning line;

and wherein the control port of the fifth switching unit and the control port of the fourth switching unit are connected to different scanning lines respectively; and the third scanning signal is not synchronized with the fourth scanning signal.

2. The pixel driving circuit according to claim 1, wherein the control port of the second switching unit and the control port of the third switching unit are connected to a same scanning line.

3. The pixel driving circuit according to claim 1, wherein the switching units are switching transistors; the gates of the switching transistors are used as the control ports of the switching units; the sources and the drains of the switching transistors are respectively used as the first signal ports and the second signal ports of the switching units; or, the sources and the drains of the switching transistors are respectively used as the second signal ports and the first signal ports of the switching units.

4. The pixel driving circuit according to claim 1, wherein the driving unit is a driving transistor; the gate of the driving transistor is used as the control port of the driving unit; the source of the driving transistor is used as the signal input port of the driving unit; the drain of the driving transistor is used as the driving port of the driving unit.

5. A driving method for a pixel driving circuit, wherein the pixel driving circuit comprises: a light emitting device, a storage capacitor, a driving unit and five switching units;

wherein each switching unit comprises a control port, a first signal port and a second signal port; the control port of the switching unit is used for inputting a control signal, thereby turning on or turning off the first signal port and the second signal port; the drive unit comprises a control port, a signal input port and a driving port, the control port and the signal input port of the driving unit are used for controlling outputting a driving signal at the driving port;

a control port of a first switching unit is used for inputting a reset signal; a first signal port of the first switching unit is used for inputting an initializing level;

a control port of a second switching unit is used for inputting a first scanning signal; a first signal port of the second switching unit is connected to a second signal port of the first switching unit;

a first electrode of the storage capacitor is connected to the first signal port of the second switching unit;

a control port of a third switching unit is used for inputting a second scanning signal; a first signal port of the third switching unit is used for inputting a data signal; a second signal port of the third switching unit is connected to a second electrode of the storage capacitor;

a control port of a fourth switching unit is used for inputting a third scanning signal; a first signal port of the fourth switching unit is used for inputting a first level; a second signal port of the fourth switching unit is connected to the second electrode of the storage capacitor;

a control port of a fifth switching unit is used for inputting a fourth scanning signal; a first signal port of the fifth switching unit is connected to a second signal port of the second switching unit;

the control port of the driving unit is connected to the first electrode of the storage capacitor; the signal input port of the driving unit is used for inputting the first level; the driving port of the driving unit is connected to the first signal port of the fifth switching unit;

a first electrode of the light emitting device is connected to a second signal port of the fifth switching unit; a second electrode of the light emitting device is used for inputting a second level;

wherein each of the scanning signals is inputted to a control port of a corresponding switching unit through a scanning line;

and wherein the control port of the fifth switching unit and the control port of the fourth switching unit are connected to different scanning lines respectively; and the third scanning signal is not synchronized with the fourth scanning signal;

and wherein the driving method comprises:

a first phase: the first signal port and the second signal port of the first switching unit are turned on; the first signal port and the second signal port of the fourth switching unit are turned on; the initializing level and the first level charge the storage capacitor;

a second phase: the first signal port and the second signal port of the second switching unit are turned on; the first signal port and the second signal port of the third switching unit are turned on; the data signal is written in the second electrode of the storage capacitor; the first electrode of the storage capacitor is discharged until the voltage difference between the control port and the signal input port of the driving unit is equal to the threshold voltage of the driving unit;

a third phase: the first signal port and the second signal port of the fourth switching unit are turned on; the first signal port and the second signal port of the fifth switching unit are turned on; the first level is coupled with the first electrode of the storage capacitor and pull up the potential of the first electrode of the storage capacitor; under the control of the output voltage of the first electrode of the storage capacitor, the driving unit outputs the driving signal at the driving port for driving the light emitting device to emit light.

6. The method according to claim 5, wherein if the switching units are switching transistors, the switching transistors comprise a cut-off state and a turn-on state.

7. The method according to claim 5, wherein if the driving unit is a driving transistor, the driving transistor is in a saturation state in the third phase.

8. A display device comprising a pixel driving circuit; wherein the pixel driving circuit comprises a light emitting device, a storage capacitor, a driving unit and five switching units;

wherein each switching unit comprises a control port, a first signal port and a second signal port; the control port of the switching unit is used for inputting a control signal, thereby turning on or turning off the first signal port and the second signal port; the drive unit comprises a control port, a signal input port and a driving port, the control port and the signal input port of the driving unit are used for controlling outputting a driving signal at the driving port;

a control port of a first switching unit is used for inputting a reset signal; a first signal port of the first switching unit is used for inputting an initializing level;

a control port of a second switching unit is used for inputting a first scanning signal; a first signal port of the second switching unit is connected to a second signal port of the first switching unit;

a first electrode of the storage capacitor is connected to the first signal port of the second switching unit;

a control port of a third switching unit is used for inputting a second scanning signal; a first signal port of the third switching unit is used for inputting a data signal; a second signal port of the third switching unit is connected to a second electrode of the storage capacitor;

a control port of a fourth switching unit is used for inputting a third scanning signal; a first signal port of the fourth switching unit is used for inputting a first level; a second signal port of the fourth switching unit is connected to the second electrode of the storage capacitor;

a control port of a fifth switching unit is used for inputting a fourth scanning signal; a first signal port of the fifth switching unit is connected to a second signal port of the second switching unit;

the control port of the driving unit is connected to the first electrode of the storage capacitor; the signal input port of the driving unit is used for inputting the first level; the driving port of the driving unit is connected to the first signal port of the fifth switching unit;

a first electrode of the light emitting device is connected to a second signal port of the fifth switching unit; a second electrode of the light emitting device is used for inputting a second level;

wherein each of the scanning signals is inputted to a control port of a corresponding switching unit through a scanning line;

and wherein the control port of the fifth switching unit and the control port of the fourth switching unit are connected to different scanning lines respectively; and the third scanning signal is not synchronized with the fourth scanning signal.

9. The display device according to claim 8, wherein the control port of the second switching unit and the control port of the third switching unit are connected to a same scanning line.

10. The display device according to claim 8, wherein the switching units are switching transistors; the gates of the switching transistors are used as the control ports of the switching units; the sources and the drains of the switching transistors are respectively used as the first signal ports and the second signal ports of the switching units; or, the sources and the drains of the switching transistors are respectively used as the second signal ports and the first signal ports of the switching units.

11. The display device according to claim 8, wherein the driving unit is a driving transistor; the gate of the driving transistor is used as the control port of the driving unit; the source of the driving transistor is used as the signal input port of the driving unit; the drain of the driving transistor is used as the driving port of the driving unit.

* * * * *